United States Patent [19]

Tarr

[11] 4,283,179

[45] Aug. 11, 1981

[54] DETACHABLE JET PROPULSION UNIT FOR WATER CRAFT AND METHOD OF CYCLIC PROPULSION

[76] Inventor: Allan L. Tarr, P.O. Box 521, Marion, Va. 24534

[21] Appl. No.: 68,776

[22] Filed: Aug. 22, 1979

[51] Int. Cl.[3] ..... B63H 11/00

[52] U.S. Cl. ..... 440/38; 114/151

[58] Field of Search ..... 115/11, 12 R, 12 A, 115/14; 114/67 A, 151; 244/207; 440/9, 10, 38, 44, 47

[56] References Cited

U.S. PATENT DOCUMENTS

| | | | |
|---|---|---|---|
| 243,656 | 6/1881 | Stucky | 115/14 |
| 868,199 | 10/1907 | Lorimer | 115/14 |
| 917,935 | 4/1909 | Elniff | 115/12 |
| 1,543,026 | 6/1925 | Paxton | 115/14 |
| 1,591,748 | 7/1926 | Dieckmann | 114/67 A |
| 2,312,976 | 3/1943 | Pelo | 115/14 |
| 2,858,764 | 11/1958 | Hesson et al. | 137/119 |
| 3,628,488 | 12/1971 | Gibson | 114/67 A |
| 3,845,777 | 11/1974 | Gilson | 137/119 |

*Primary Examiner*—Edward R. Kazenske

*Attorney, Agent, or Firm*—Baker & McKenzie

[57] ABSTRACT

Disclosed is a detachable jet propulsion unit adapted to be externally mounted on the hull of a water craft. The propulsion unit comprises (a) a base, a first side of which is shaped to conform closely to the exterior of the hull of a water craft and which contains a plenum for water maintained at high pressure, (b) an apparatus for introducing water at a high pressure into the plenum in the base, (c) a plurality of jet nozzles carried by the base and in fluid communication with the plenum in the base, and (d) a mounting assembly for detachably mounting the base on the exterior hull of a water craft. A plurality of the propulsion units may be mounted on the hull of the water craft for propelling the water craft by cyclically expelling water through the nozzles sequentially from the bow to the stern of the water craft.

6 Claims, 8 Drawing Figures

FIG. 1
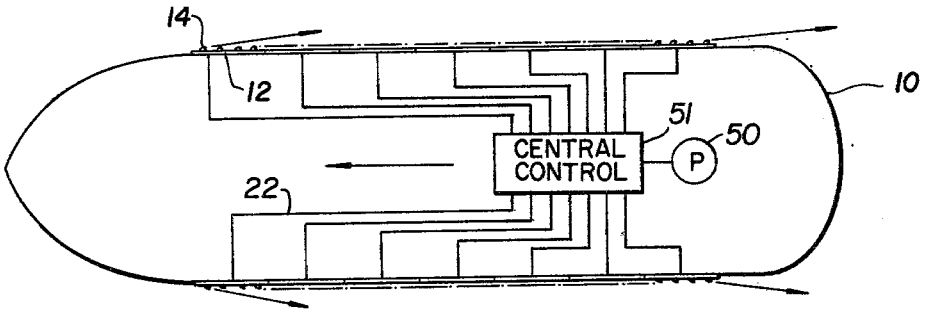
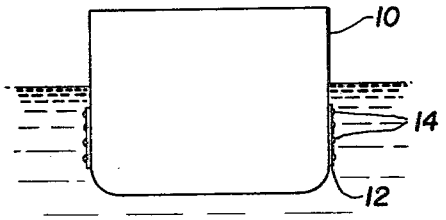
FIG. 2
FIG. 3
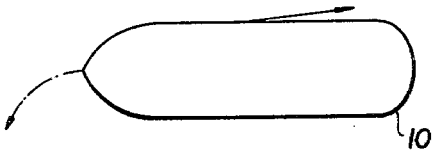
FIG. 4
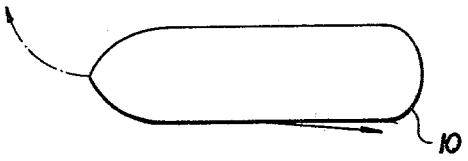
FIG. 5
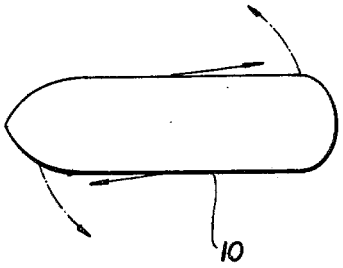
FIG. 6
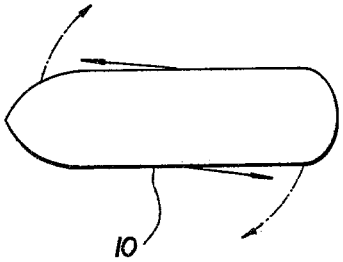

DETACHABLE JET PROPULSION UNIT FOR WATER CRAFT AND METHOD OF CYCLIC PROPULSION

TECHNICAL FIELD

This invention relates to the propulsion of water craft. In particular, it relates to the propulsion of water craft by hydraulic jets.

BACKGROUND OF THE PRIOR ART

The propulsion and steering of water craft by means of a large number of hydraulic jets is well known, and is shown for instance in U.S. Pat. No. 243,656, issued in 1881 to Stuckey, and No. 3,779,119, issued in 1973 to Mayer. However, such systems are not believed to have gone into general use, in part because they require the complete redesign of the interior of the water craft.

OBJECTS OF THE INVENTION

It is, therefore, a general object of this invention to provide a jet propulsion unit for water craft which does not require the redesign of the interior of the water craft.

It is a particular object of this invention to provide a jet propulsion unit for water craft which will operate silently.

It is a further object of this invention to provide a jet propulsion unit for water craft a large number of which can be detachably mounted on the exterior of the hull of a water craft.

It is still a further object of this invention to provide a jet propulsion unit for water craft, a large number of which can be mounted on the exterior of the hull of a water craft, whereby the jet propulsion units can be actuated cyclically and sequentially from the bow to the stern of the water craft, achieving a rippling effect similar to the body action of fishes.

It is yet a further object of this invention to provide a jet propulsion unit for water craft which can be used as either a supplement to or a replacement for conventional propulsion and/or steering systems.

It is another object of this invention to provide a jet propulsion unit for water craft which is highly energy efficient.

It is still another object of this invention to provide a jet propulsion unit for water craft which greatly enhances the maneuverability of the water craft.

Other objects and advantages of the present invention will become apparent from the following detailed description of a preferred embodiment taken in conjunction with the accompanying drawings.

BRIEF SUMMARY OF THE INVENTION

The invention is a detachable jet propulsion unit adapted to be externally mounted on the hull of a water craft. The propulsion unit comprises (a) a base, a first side of which is shaped to conform closely to the exterior of the hull of a water craft and which contains a plenum for water maintained at high pressure, (b) means for introducing water at a high pressure into the plenum in the base, (c) a plurality of jet nozzles carried by the base, and (d) means for detachably mounting the base on the exterior hull of a water craft.

BRIEF DESCRIPTION OF THE DRAWINGS

FIG. 1 is a highly schematic plan view of a ship incorporating the subject invention.

FIG. 2 is a highly schematic cross-sectional view of a ship incorporating the subject invention.

FIGS. 3 through 6 are highly schematic plan views of ships incorporating the subject invention illustrating its use in steering a ship.

DETAILED DESCRIPTION OF THE PRESENTLY PREFERRED EMBODIMENT OF THE INVENTION

Figure 7:
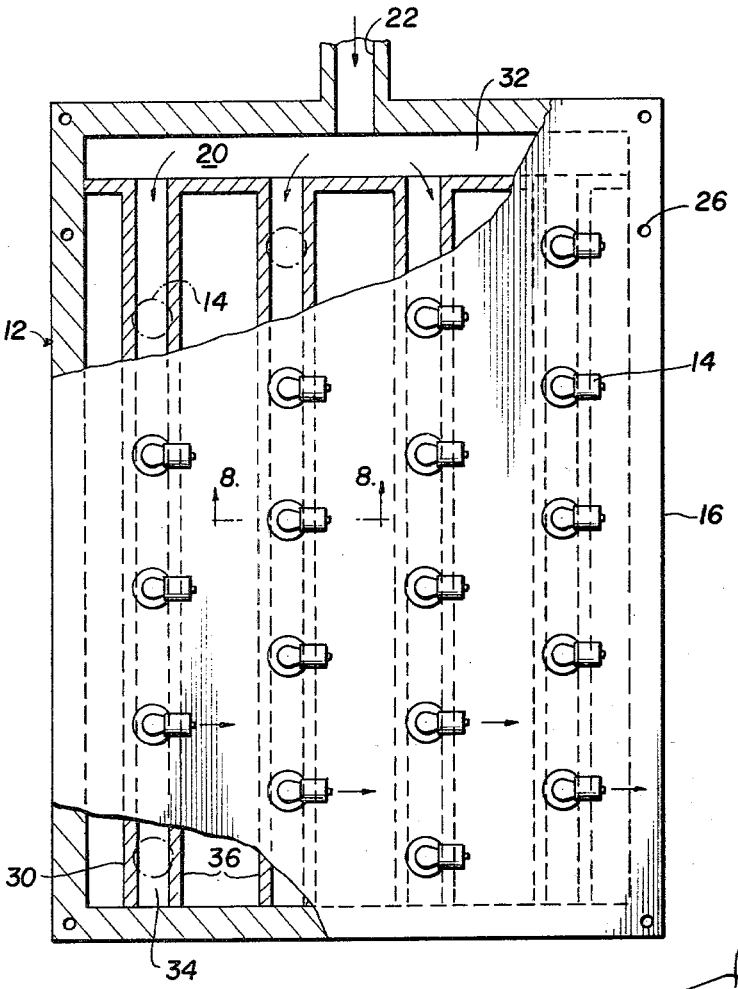
FIG. 7 is a partially broken-away plan view of a propulsion unit according to the subject invention.

Shown in FIGS. 1 and 2 are highly schematic views of a ship 10 along the exterior of the hull of which a plurality of jet propulsion units 12 are detachably mounted. Each jet propulsion unit 12 comprises a plurality of jet nozzles 14. As shown, some of the nozzles 14 are pointed towards the stern of the ship 10 and are angled to diverge uniformly from the side of the ship 10. Other nozzles are pointed towards the bow of the ship 10, as shown in FIGS. 5 and 6.

FIG. 1 illustrates the use of the propulsion units 12 in straight propulsion. The speed achieved by the ship 10 is, of course, a function of the velocity and mass of the water exiting the nozzles 14, the number of nozzles 14, and the mass of the ship 10, as well as of other minor factors.

FIGS. 3 through 6 illustrate the use of the propulsion units 12 in maneuvering the ship 10. In FIG. 3, the ship 10 is being propelled forwardly and to the left by use of starboard propulsion units 12 only. In FIG. 4, the ship 10 is being propelled forwardly and to the right by use of port propulsion units 12 only. In FIG. 5, the ship 10 is being rotated counter-clockwise about its center of mass by use of rearwardly directed propulsion units 12 on its starboard side and forwardly directed propulsion units on its port side. In FIG. 6, the ship 10 is being rotated clockwise about its center of mass by use of rearwardly directed propulsion units 12 on its port side and forwardly directed propulsion units 12 on its starboard side. Although not shown, a ship 10 could also be propelled rearwardly by the use of only forwardly directed propulsion units 12. Also, of course, a combination of any of these maneuvers can be accomplished by the judicious selection of the number of forwardly or rearwardly directed propulsion units 12 on each side of the ship 10 and/or by varying the momentum of the water exiting from various propulsion units.

Figure 8:
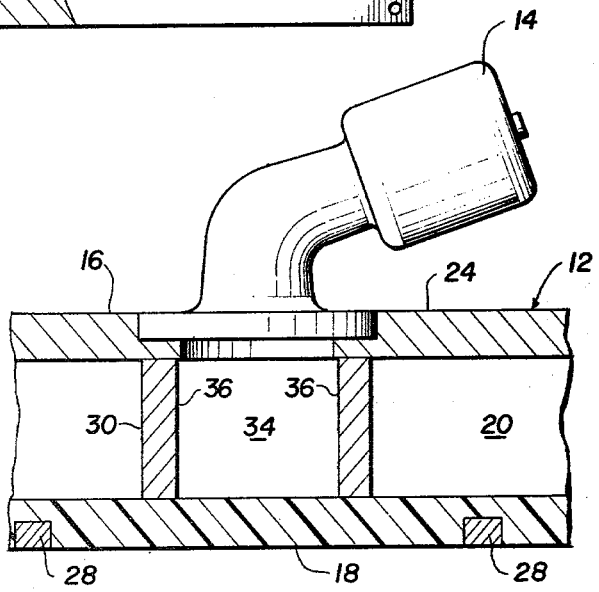
FIG. 8 is a view on a larger scale along the line 8—8 in FIG. 7.

FIGS. 7 and 8 illustrate the presently preferred embodiment of the propulsion units 12 in greater detail. As shown therein, the propulsion units 12 comprise a base 16 a first side 18 of which is shaped to conform closely to the exterior of the hull of a water craft. The base 16 contains a plenum 20 for water maintained at high pressure, and means 22 for introducing water at a high pressure into the plenum 20 are provided. It is contemplated that the means 22 would be connected by suitable conduits to a pump 50 located in the interior or on the deck of the water craft.

The propulsion units 12 also comprise a plurality of jet nozzles 14 carried by the base 16 on a second side 24 opposite from the first side 18. As shown in FIG. 8, the jet nozzles 14, which may be of any suitable construction, are in fluid communication with the plenum 20.

Finally, the propulsion units 12 also comprise means 26 for detachably mounting the base 16 on the exterior hull of a water craft. The means 26 can comprise clearance holes through the base 16 for the reception of fastening means and/or magnetic materials 28 contained in the base 16.

The base 16 is preferably generally in the shape of a rectangular parallelepiped the dimension of which between the first and second sides is small relative to the other dimensions. It is preferably made of a flexible material, such a high-impact plastic resin, so that it can conform to differently shaped portions of the exterior of the hull of a water craft. However, this invention is particularly adapted for use on oil tankers, which have long, flat sides, so the flexibility feature is not important in all contexts, and the base 16 can also be made out of steel or other inflexible materials.

The base 16 preferably includes channelization means 30 in the plenum 20 to guide water from the means 22 to the nozzles 14. As shown, the channelization means 30 can comprise a manifold 32 in fluid communication with a plurality of straight conduits 34 defined by transverse walls 36 extending from the side 18 to the side 24. In addition to providing channelization of the water, it will be readily appreciated that the walls 36 double as structural elements which provide strength to the base 16.

It will be appreciated that the various means 22 and/or the pump 50 connected to the conduits leading to the means 22 must be controlled by some sort of central control means 51 used to determine to which propulsion units 12 water should be pumped at any given time and/or the velocity (pressure) with which water should be pumped. In addition to maneuvering the craft in the fashion discussed previously in connection with FIGS. 3 through 6, it is also within the contemplation of this invention to cyclically introduce water at high pressure into the propulsion units 12 sequentially from the bow to the stern of the craft, achieving a rippling effect of the water expelled through the jet nozzles 14. Suitable control means 51 are known in the art and disclosed for instance in U.S. Pat. No. 2,858,764 and U.S. Pat. No. 3,845,777. It is believed that this rippling effect simulates the body action of fishes and will increase the speed of the craft and reduce the sound of its passage through the water.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiments.

I claim:

1. A method of propelling a water craft having a plurality of propulsion units mounted one behind the other on the exterior hull of said water craft between the bow and stern thereof, each of said propulsion units comprising:

(a) a base, a first side of which is shaped to conform closely to the exterior of the hull of the water craft, said base containing a plenum for water maintained at high pressure;

(b) first means for introducing water at a high pressure into the plenum in said base;

(c) a plurality of jet nozzles carried by said base on a second side thereof opposite from the first side, said nozzles being in fluid communication with the plenum in said base; and (d) second means for detachably mounting said base on the exterior hull of the water craft, said method comprising the step of cyclically introducing water at high pressure into said propulsion units sequentially from the bow to the stern of the water craft, whereby a rippling effect of the water expelled through said jet nozzles is achieved.

2. A method of propelling a water craft having a plurality of jet nozzles disposed one behind the other on the exterior hull of the water craft between the bow and stern thereof, said method comprising the step of cyclically expelling water at high pressure through said nozzles sequentially from the bow to the stern of the water craft, whereby a rippling effect of the water expelled through said jet nozzles is achieved.

3. A detachable jet propulsion unit adapted to be externally mounted on the hull of a water craft without piercing the hull of the water craft, said propulsion unit comprising:

(a) a base generally in the shape of a rectangular parallelepiped, said base having a first side which is shaped to conform closely to the exterior hull of a water craft and a second side which is spaced from said first side to define a plenum for water maintained at high pressure, the dimension of said base between said first and second sides being small relative to the other dimensions;

(b) first means for introducing water at a high pressure into the plenum in said base;

(c) a plurality of jet nozzles carried by said base on the second side thereof, said nozzles being in fluid communication with the plenum in said base;

(d) channelization means in the plenum in said base to guide water from said first means to said nozzles; and (e) second means for detachably mounting said base on the exterior hull of the water craft.

4. A propulsion unit as recited in claim 1 wherein said base is made of a flexible material, whereby said base can conform to differently shaped portions of the exterior of the hull of a water craft.

5. A propulsion unit as recited in claim 1 wherein said jet nozzles are angled to diverge uniformly from the second side of said base.

6. A propulsion unit as recited in claim 1 wherein said second means comprises clearance holes through said base for the reception of fastening means.

* * * * *